US009725790B2

(12) United States Patent
Palm

(10) Patent No.: US 9,725,790 B2
(45) Date of Patent: Aug. 8, 2017

(54) PROCESS FOR PRODUCING AN ALUMINUM-SCANDIUM-CALCIUM ALLOY

(75) Inventor: Frank Palm, Unterhaching (DE)

(73) Assignee: Airbus Defence and Space GmbH, Taufkirchen (DE)

( * ) Notice: Subject to any disclaimer, the term of this patent is extended or adjusted under 35 U.S.C. 154(b) by 804 days.

(21) Appl. No.: 13/990,882

(22) PCT Filed: Nov. 30, 2011

(86) PCT No.: PCT/DE2011/002050
§ 371 (c)(1),
(2), (4) Date: Aug. 13, 2013

(87) PCT Pub. No.: WO2012/075993
PCT Pub. Date: Jun. 14, 2012

(65) Prior Publication Data

US 2013/0312876 A1 Nov. 28, 2013

(30) Foreign Application Priority Data

Dec. 2, 2010 (DE) ..... 10 2010 053 274

(51) Int. Cl.

| | |
|---|---|
| ***C22C 1/02*** | (2006.01) |
| ***C22C 21/00*** | (2006.01) |
| ***C22C 21/06*** | (2006.01) |
| ***C22F 1/047*** | (2006.01) |
| *B33Y 70/00* | (2015.01) |

(52) U.S. Cl.
CPC ..... *C22C 1/026* (2013.01); *C22C 21/00* (2013.01); *C22C 21/06* (2013.01); *C22F 1/047* (2013.01); *B33Y 70/00* (2014.12)

(58) Field of Classification Search
CPC ..... C22C 1/026; C22C 21/00; C22F 1/047
USPC ..... 148/549, 440
See application file for complete search history.

(56) References Cited

U.S. PATENT DOCUMENTS 5,122,205 A * 6/1992 Masumoto ..... C22C 45/08 148/403
5,211,910 A 5/1993 Pickens et al.

FOREIGN PATENT DOCUMENTS

| | | | |
|---|---|---|---|
| CN | 100402683 | C | 7/2008 |
| EP | 1 413 636 | A1 | 4/2004 |
| EP | 2 112 243 | A1 | 10/2009 |
| JP | 2007254822 | A * | 10/2007 |
| WO | WO 2007/102988 | A2 | 9/2007 |

OTHER PUBLICATIONS

Machine translation of JP2007254822A, Oct. 2007.*
Corresponding International Search Report with English Translation dated Jul. 6, 2012 (seven (7) pages).
German-language Written Opinion dated Jul. 6, 2012 (PCT/ISA/237) (seven (7) pages).
German Office Action dated Aug. 5, 2011 (five (5) pages).
(Continued)

*Primary Examiner* — Jie Yang
(74) *Attorney, Agent, or Firm* — Crowell & Moring LLP

(57) ABSTRACT

Calcium is added to an aluminum-scandium alloy to produce an aluminum-scandium-calcium alloy by combining aluminum, scandium, and the calcium in a melt, where the common melt is then quenched at a high velocity.

7 Claims, 2 Drawing Sheets

(56) References Cited

OTHER PUBLICATIONS

Figure 1:
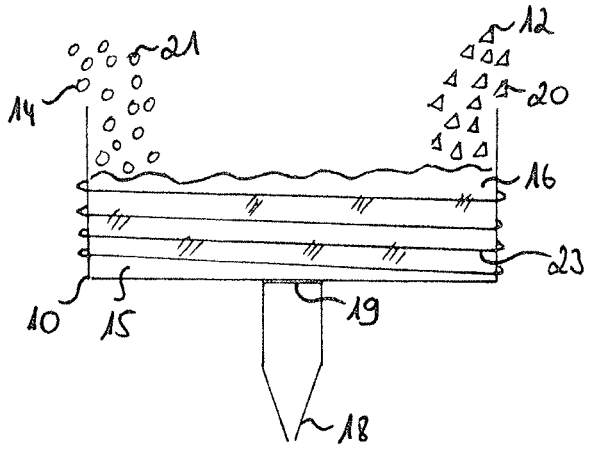

"Aluminium Based Master Alloys with Alloying Elements", URL: http://kbmaffilips.com/aluminium_based_en.html [abgerufen am, Apr. 8, 2011] (four (4) pages).
Schmelzschleudern. In: Wikipedia, Die Freie Enzyklopaedie. Bearbeitungsstand: Jun. 17, 2010, URL: http://de.wikipedia.org/wiki/Schmelzschleudern, [abgerufen am Apr. 8, 2011] (one (1) page).

* cited by examiner

PROCESS FOR PRODUCING AN ALUMINUM-SCANDIUM-CALCIUM ALLOY

BACKGROUND AND SUMMARY OF THE INVENTION

Exemplary embodiments of the present invention relates to a method for alloying calcium to an aluminum-scandium alloy and an aluminum-scandium-calcium alloy.

Aluminum is preferentially used as a construction material because of its low density; that is, in applications where low mass is desired, such as in transportation vehicles, especially in air and space travel. Aluminum is a light metal and is therefore interesting for such applications, but has the disadvantage that it is relatively soft and has a tensile strength in an annealed state of only 30-50 MPa. The strength values of aluminum can be increased within wide limits by alloying with other metals, and other properties can also be thereby influenced. This is advantageous for lightweight construction, as construction materials having a high specific strength are required here. For example, by alloying scandium in connection with a sufficiently rapid cooling after casting, a much greater strength increase can be achieved through precipitation hardening via a fully or partially coherent $Al_3Sc$ phase and/or via dispersoid hardening—that is, if the $Al_3Sc$ phases become increasingly incoherent due to excess aging—in addition to increased strength due to mixed crystal formation. Since the density of scandium, at 2.98 g/cm$^3$, is greater than that of aluminum, at 2.7 g/cm$^3$, however, scandium increases the material density and thus also the overall weight.

Aluminum-scandium alloys are well known and their properties are described in the following publications which form part of this disclosure by reference:

A. J. Bosch, R. Senden, W. Entelmann, M. Knüwer, F. Palm "Scalmalloy®: A unique high strength and corrosion insensitive AlMgScZr material concept," Proceedings of the 11$^{th}$ International Conference on Aluminium Alloys F. Palm, P. Vermeer, W. von Bestenbostel, D. Isheim, R. Schneider "Metallurgical peculiarities in hyper-eutectic AlSc and AlMgSc engineering materials prepared by rapid solidification processing," Proceedings of the 11$^{th}$ International Conference on Aluminium Alloys.

In order to reduce the density of said aluminum-scandium alloys, in addition to the adding of magnesium (density 1.74 g/cm$^3$) described in the aforementioned publications, it is particularly possible to add lithium to the alloy, which has a density of 0.5 g/cm$^3$.

The production of aluminum-scandium-lithium alloys is problematic in production, however, since the melt must be handled under protection gas, such as argon. Furthermore, channels and melting pots must be specially lined, such as with CeO, ZrO or other protective metal oxides. The melt reacts easily to air with fire or explosion and has consequently frequently been separated from the environment in past production processes by a protective slag, as well.

U.S. Pat. No. 5,211,910 describes an aluminum alloy that can have scandium and/or calcium at a ratio of 0.5 to 4 wgt.-%.

PCT Publication No. WO 2007/102988 A2 discloses an aluminum alloy that can have calcium and/or scandium in a range from 0.01 to 6%.

In the German Wikipedia, a method is described under the term "Schmelzschleudern" ("melt spinning") wherein melts, particularly metal melts, are cooled—that is, quenched—at very high velocities KBM AFFILIPS Master Alloys offers aluminum master alloys on its website, such as aluminum-magnesium alloys, aluminum-scandium alloys or aluminum-calcium alloys.

Exemplary embodiments of the present invention provide a simple and safe method for producing an aluminum-scandium alloy having reduced density.

A method for alloying calcium to an aluminum-scandium alloy in order to produce an aluminum-scandium-calcium alloy has the following steps:

a) combining aluminum, scandium and calcium together in a melt; and b) quenching the common melt.

Calcium, having a density of 1.55 g/cm$^3$, has a significantly lower volume weight than aluminum, and thus contributes to a reduction of the total density of the alloy when added to an aluminum-scandium alloy.

A material produced from such an alloy is light and still extensively has the strength properties of the aluminum-scandium alloy.

The melt having calcium can be handled under atmospheric conditions without trouble, so that safety precautions such as the lining of channels and pots with oxides and the use of protection gas are not necessary.

The solubility of calcium in aluminum is very low, so that no significant alloy volumes greater than 0.5 wgt.-% have been producible to date. If the melt that fundamentally comprises the alloy partners is rapidly quenched and a rapid solidification process is thus carried out, however, calcium remains extensively in solution in the solid phase.

An aluminum alloy having high strength and low density can thus be produced in a simple and safe method.

Calcium is preferably added to the alloy at a ratio of more than 0.5 wgt.-%. Calcium is thus present in the alloy at a significant ratio and considerably reduces the weight of the alloy and also of the materials produced therefrom.

Calcium is preferably added to the alloy at a ratio which achieves a density less than 2.6 g/cm$^3$. The weight of the alloy can thus be reduced by approximately 5% compared to the aluminum-scandium alloy.

The common melt is advantageously quenched by means of a rapid solidification process at a velocity of more than 11 K/s, particularly 10,000 K/s to 10,000,000 K/s. In a normal metallurgical production path, wherein after the smelting a cast-solidification having slow cooling conditions occurs, it is difficult to add calcium in significant volume to an aluminum-scandium alloy. An $Al_2Ca$ phase forms immediately, which is eliminated and the alloy embrittles. If a rapid solidification process is carried out, however, the problem of limited solubility and unintentional early, grossly property-deteriorating elimination of calcium in aluminum alloys can be overcome and calcium remains extensively in solution, since the natural crystallization is prevented by the rapid cooling. The atoms are thus robbed of movement before they can take on a crystalline arrangement and $Al_2Ca$ can thus be formed.

Methods suitable for this are all solidification methods in which heat is rapidly extracted from the melt, such as melt spinning, powder atomizing by means of gas or in water, thin strip casting or spray compacting, but also methods wherein a melt is produced in a short period of time and immediately solidifies again, such as welding processes for connecting, surface modifying or generative production of three-dimensional components—so-called "additive manufacturing."

According to the invention, the common melt is advantageously sprayed onto a substrate as a nozzle jet, wherein the substrate is cooled and rotated during the applying of the common melt. The substrate can be, for example, a copper wheel cooled by water. A temperature difference between the common melt and the substrate results due to the cooling, so that a temperature transfer occurs from the melt to the substrate. The higher the temperature difference, the faster the temperature on the substrate is transferred and discharged by the cooling. The cooling rate, and thus the presence of a rapid solidification in order to prevent the $Al_2Ca$ phase formation, furthermore depends on the velocity at which the melt meets the substrate and on the rotation velocity of the rotated substrate.

If the substrate is preferably rotated so quickly that the quenched common melt is spun off from the substrate starting from a point of impact of the nozzle jet on the substrate, the substrate is automatically freed from the solid alloy, already formed by quenching, and is available for subsequently sprayed common melt for cooling. An accumulation of alloy material on the substrate, which is contrary to a rapid temperature transfer from the common melt to the substrate, is thus advantageously prevented. The spun-off common melt forms a band that can be further processed in subsequent method steps.

For example, the band is first chopped small, processed into granulate or powder and then compacted in a pressing and outgassing/baking method into bolts. The bolts—that is, the particulate pre-material—can then be extruded into extruded sections having various cross-sections.

The method is preferably carried out under atmospheric conditions, particularly in contact with air. Measures for protecting the common melt from the atmosphere are no longer required and thus the use of protection gas, vacuum conditions, guard devices and the like can be omitted. This simplifies the method and makes it significantly more cost-effective in comparison to adding lithium to the alloy.

Step a) particularly preferably comprises the step of combining an aluminum-magnesium master alloy into the melt. Magnesium has a density of 1.74 g/cm$^3$. It controls and simultaneously reduces the density of the corresponding alloy. The more magnesium is found in the alloy, the lower the density. The adding of magnesium to the aluminum alloy is sensible up to a ratio of 10 wgt.-%. As a result of the similar melting points of aluminum and magnesium, production of an aluminum-magnesium master alloy is particularly simple to execute.

Aluminum-scandium alloy is a generic term for all alloys that comprise aluminum and scandium. These alloys include all compositions having the formula $AlScM^1M^2M^3M^4$, wherein $M^1$ is a metal selected from the group comprising copper, magnesium, manganese, silicon, iron, beryllium, lithium, chromium, zinc, silver, vanadium, nickel, cobalt and molybdenum, and wherein $M^2$ is a metal selected from the group comprising copper, magnesium, manganese, silicon, iron, beryllium, lithium, chromium, zinc, silver, vanadium, nickel, cobalt and molybdenum.

$M^3$ comprises the group of elements having a certain compatibility with the $Al_3Sc$ phase—that is, metal-physical similarity (interchangeability)—and therefore can form the tertiary phase $Al_3Sc_1$-$xM_3x$. These are primarily zirconium, niobium, tantalum and titanium.

$M^4$ comprises the group of so-called rare earth metals (element numbers 39 and 57 to 71), which generally have great similarity to scandium. Sc is consequently often incorrectly attributed to the rare earth metals. They can also be added to the alloy to a significant extent, in addition to the scandium, and then form a hardening phase, in addition to the mixed crystal hardening, alone or together with scandium, having comparable stoichiometry to $Al_3Sc_1$-$xM_3x$.

Additionally, an aluminum-scandium pre-alloy is preferably introduced to the melt in step a). Scandium has a significantly higher melting point than aluminum and a long holding time must be maintained as a result in order to form an alloy. Because this is expensive it is advantageous when, instead of the pure elements, a pre-alloy is used wherein the scandium is already "melted in" and consequently a shorter holding time must be maintained to form the aluminum-scandium-calcium alloy.

Additionally, an aluminum-calcium pre-alloy is preferably introduced to the melt in step a). Calcium also has a significantly higher melting point (842° C.) than aluminum and the required melting point and thus the holding time are preferably reduced by the pre-alloying.

An aluminum-scandium-calcium alloy has a calcium ratio of more than 0.5 wgt.-%. The density of the aluminum-scandium alloy can thus be reduced in that an easily available and simple to handle metal is comprised in the alloy as an alloy component.

The alloy preferably has 0.2 wgt.-% to 3 wgt.-%, preferably 0.4 wgt.-% to 1.5 wgt.-% scandium. If scandium is comprised in the alloy in the specified volumes, it increases the strength of the alloy but does not so heavily contribute to an increase in density of the alloy that a material produced therefrom would be too heavy for lightweight construction. Alternatively, ytterbium can also be added to the alloy in the cited ratios instead of scandium. Ytterbium is more cost-effectively obtainable than scandium, but has the disadvantage that it improves the strength of the alloy less than scandium.

The alloy preferably has 0.1 wgt.-% to 1.5 wgt.-%, more preferably 0.2 wgt.-% to 0.75 wgt.-% zirconium. Zirconium, in such a ratio in the alloy (Zr/Sc ratio approximately ½ to approximately ¼) makes temperature-supported further processing of the alloy easier and stabilizes it thermally; that is, it reduces the inclination toward "aging," which is synonymous with an unintended coarsening of the hardening phase $Al_3Sc$ by forming an $Al_3ScZr$ phase.

Additionally, the alloy preferably comprises 1.0 wgt-% to 8.0 wgt.-%, more preferably 2.5 wgt.-% to 6.0 wgt.-% magnesium. Magnesium reduces the density of an aluminum alloy. The adding of magnesium to aluminum is only sensible up to certain volumes, however, since otherwise negative properties such as brittleness and corrosion sensitivity heavily increase. For that reason, magnesium is preferably comprised in the alloy at the cited ratios.

Furthermore, the alloy also preferably has additional admixtures, also in multiple form, the elements cited in $M^1$, $M^2$, $M^3$ and $M^4$ having the ratios 0.2 to 2.0 wgt.-% which improve the mechanical, physical or chemical properties of the alloy. The presence of undesirable contaminants of a metallic but also non-metallic nature, such as oxides, nitrides, released gases, et cetera in negligible volumes—that is, totaling less than 0.5 wgt.-%—is unavoidable.

The alloy preferably has a density of less than 2.6 g/cm$^3$. The alloy is thus particularly well suited as a raw material for lightweight construction.

In the preferred design, the alloy essentially has the same strength and essentially has the same elasticity module as the pure aluminum-scandium alloy which comprises no added calcium. The alloy thus has the positive properties of the aluminum-scandium master alloy; that is, essentially the same strength and the same elasticity module, but is density-reduced by the presence of calcium and is thus lighter.

An aluminum-scandium-calcium material has more than 0.5 wgt.-% calcium. Such a material is characterized by particularly favorable strength values and a high elasticity module, but has reduced density and is thus particularly well suited for lightweight construction.

BRIEF DESCRIPTION OF THE DRAWING FIGURES

Figure 2:
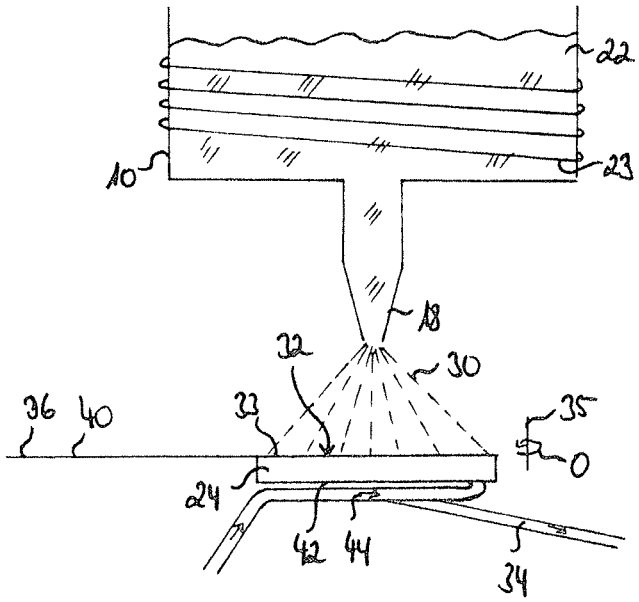
Figure 3:
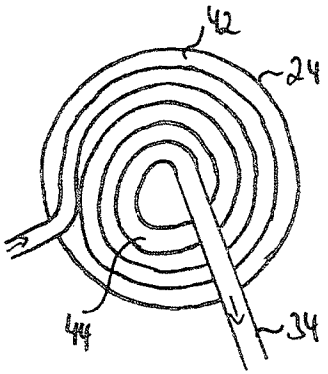

An embodiment of the invention is explained in more detail in the following, based on the enclosed drawings. Therein is shown:

FIG. 1 the combining of aluminum, scandium and calcium together in a melt;

FIG. 2 the quenching of the common melt by spraying onto a cooled, rotating substrate;

FIG. 3 a rear-side view of the substrate; and

Figure 4:
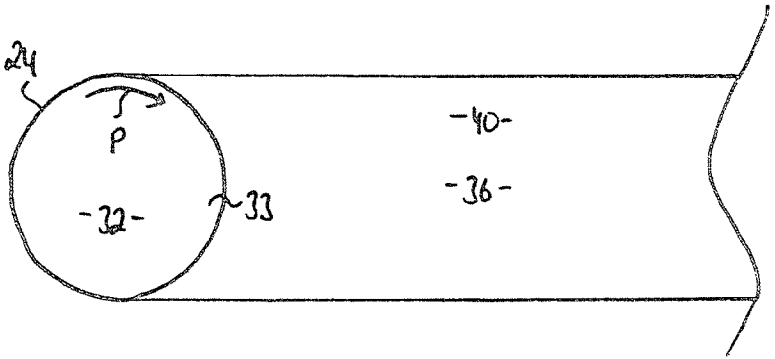

FIG. 4 the producing of an alloy band.

DETAILED DESCRIPTION

FIG. 1 shows how the metals scandium 12 and calcium 14 are mixed into an aluminum-magnesium master alloy 17 comprising aluminum 15 and magnesium 16 in a common melting crucible 10. The melting crucible 10 has a nozzle 18 on the bottom side thereof which is separated from the melting crucible 10 by a closing device 19.

In order to achieve holding times that are as short as possible, scandium 12 is added as an aluminum-scandium pre-alloy 20 and calcium 14 is added as an aluminum-calcium pre-alloy 21. The mixture is heated by induction heating 23 for melting. However, other suitable heating options for introducing the metals 12, 14, 15, 16 into the melt are also possible. After the metals 12, 14, 15, 16 input into the melting crucible 10 have melted, a common melt 22 is produced.

FIG. 2 shows how the common melt 22 is sprayed onto a rotating substrate 24. To do so, the closing device 19 between the nozzle 18 and the melting crucible 10 is opened so that the common melt 22 can flow into the nozzle 18. The nozzle 18 sprays the common melt 22 in a nozzle jet 30 onto an impact region 32 on a surface 33 of the substrate 24. The substrate 24 is cooled on the side opposite the impact region 32 by a cooling device 34. The substrate 24 is rapidly rotated in the direction of the arrow O around the axis 35.

The common melt 22 solidifies on the cooled substrate 24 at a high cooling velocity into an aluminum-scandium-calcium alloy 36. Due to the rapid rotation of the substrate 24 and the resulting forces, the aluminum-scandium-calcium alloy 36 that is produced is spun away from the surface 33 of the substrate 24 so that an alloy band 40 is produced.

FIG. 3 shows the substrate 24 from a rear side 42, which is opposite the surface 33. Here, the cooling device 34 is arranged in the form of a cooling spiral. Water can be directed by the cooling spiral 44 in the direction of the arrow, for example, in order to cool the substrate 24. It is also possible, however, to use liquid nitrogen or other lower-melting media than water in order to achieve a greater temperature difference between the impacting nozzle jet 30 and the substrate 24.

FIG. 4 shows a view of the surface 33 of the substrate 24. The substrate 24 is rotated in the direction of the arrow P so quickly that, due to the resulting forces, the solidified aluminum-scandium-calcium alloy 36 is spun away from the surface 38 as an alloy band 40.

In the following example, the production of an AlScCa alloy semi-finished product is described.

2.0 wgt.-% calcium is added to an AlMg5.4Sc1.2Zr0.6Mn0.5 alloy according to the method described above. The alloy band is chopped into granulate and then degassed in a heatable device at 290 to 300° C. under cyclic flushing with vacuum at approximately 10 to 2 mbar and supplying of dry nitrogen and repeated vacuum suctioning. The degassing process is carried out five times and in doing so the granulate is compacted by means of a hydraulic press into a bolt having 98% gross density and 31 mm diameter and 25-30 mm length.

The bolt is then overtwisted to 30 mm and subsequently pressed out into a 6 mm round bar in an extrusion device having a compression ratio of 25:1 at 325 to 335° C. Standardized round bar samples EN 10001 B6×30 are taken from the round bar and the strength is examined. The structural hardness according to the Brinell hardness testing method (HB2.5/6.5) can then additionally be determined on small discs from the 6 mm rod.

The lower the material density, the greater the lightweight construction potential; this is a fixed design parameter when strength properties are otherwise constant. Material-based lightweight construction requires construction materials having high strength and low density; that is, high specific strength, also called breaking length. High-strength AlMgSc alloys have a density of 2.62 to 2.86 g/cm$^3$ and a Mg content of 6.0 to 2.5 Gew.-%. AlMg materials, which are all written in field AA5XXX according to the American Al alloy key in their composition, are widely distributed due to their relatively low density and are very popular due to their good strength and processing properties. The magnesium portion of the alloy partially controls the strength of the mixed crystalline hardening, but at the same time also determines the density of the corresponding alloys, since magnesium 16 has a density of 1.74 g/cm$^3$. This should be as low as possible, particularly in respect of lightweight construction concerns. The more magnesium 16 is found in the alloy, the lower the density. It is known that the adding of magnesium 16 to aluminum 15, and thus the consequential density reduction, is only sensible up to certain volumes, since otherwise negative properties such as brittleness and corrosion sensitivity heavily increase.

For that reason, established—that is, industrially used—high-magnesium content aluminum materials generally have a magnesium content of under 6 wgt.-% (e.g. AA5059 or AA5083). The adding of lithium to the alloy is prior art; the adding of calcium 14 in AlMgSc alloys is not. The alternative to lowering the density—that is, the adding of lithium having a density of 0.52 g/cm$^3$—was already developed in the 20's of the last century and technically implemented particularly from the late 70's in Russia. A further density reduction is thus possible by adding lithium (0.5 g/cm$^3$) or calcium 14 (1.55 g/cm$^3$) to the alloy. The adding of scandium 12 in connection with sufficiently rapid cooling after casting or during solidification enables in said materials, by means of defined heat control, e.g. downstream artificial aging in the temperature range between 250 and 400° C., a further strength increase of the precipitation hardening via a fully or partially coherent $Al_3Sc$ phase and/or dispersoid hardening if the $Al_3Sc$ phase becomes increasingly incoherent due to overaging.

The density of AlMgSc plate and moreover of extrusion profiles is determined by the volume of magnesium 16, which is added to the alloy for mixed crystalline hardening of said material type. From this results a downward-limited minimum density in the case of more solid AlMgSc alloys. The adding of calcium 14, having a density of 1.55 g/cm$^3$ and in a volume of more than 0.5 wgt.-%, is not previously known in high-strength aluminum-magnesium-scandium alloy concepts for applications in the transportation and aerospace fields.

Since the solubility of calcium 14 in aluminum 15 is very low, the use of calcium 14 as a standard alloy element is prohibited at significant alloy volumes of greater than 0.5 wgt.-%. However, this only applies for the normal metallurgical production method, wherein a casting and solidification having slow cooling conditions occurs after smelting and immediately excretes an $Al_2Ca$ phase which embrittles the alloy.

If a rapid solidification process, such as melt spinning, is carried out, the problem of the very limited solubility of calcium 14 in aluminum 15 and aluminum-magnesium alloys 17 can be overcome and calcium 14 remains substantially in solution. Sufficiently rapidly solidified aluminum-magnesium materials, alloyed with scandium 12 between 0.3 and 1.5 wgt.-% and therefore high-strength to highest strength and having a magnesium content between 1 and 10 wgt.-%, can be further density-reduced by adding calcium 14 in a range between 0.5 and 5 wgt.-% and thus increase their attractiveness as lightweight construction materials due to the high specific strength for all types of weight-driven applications, such as aircraft construction, vehicle construction, et cetera.

As a result of the rapid cooling and solidification from the liquid phase, which is required so that increased volumes of scandium 12 can be dissolved in the aluminum material, the alkaline-earth element calcium 14 having a density of 1.54 g/cm$^3$ can then be added to the aluminum-magnesium-scandium alloys and the density of said attractive, high-strength aluminum materials further reduces. High-strength aluminum-magnesium-scandium materials having reduced density of less than 2.6 g/cm$^3$ can be achieved as profiles, although also high-strength aluminum-magnesium-scandium materials having reduced density of less than 2.6 g/cm$^3$ as direct-generated (e.g. remelted by laser), close-contoured components, wherein the components are more efficient lightweight structures having high durability.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

REFERENCE LIST

10 Melting crucible
12 Scandium
14 Calcium
15 Aluminum
16 Magnesium
17 Aluminum-magnesium master alloy
18 Nozzle
19 Closing device
20 Aluminum-scandium pre-alloy
21 Aluminum-calcium pre-alloy
22 Common melt
23 Induction heating
24 Substrate
30 Nozzle jet
32 Impact region
33 Surface
34 Cooling device
25 Axis
36 Aluminum-scandium-calcium alloy
40 Alloy band
42 Rear side
44 Cooling spiral
O Arrow
P Arrow

The invention claimed is:

1. A method for adding calcium to an aluminum-scandium-magnesium-zirconium alloy for producing an aluminum-scandium-magnesium-zirconium-calcium alloy, the method comprising the steps:

a) combining aluminum, scandium, magnesium, zirconium and calcium together in a common melt; and b) quenching the common melt by a rapid solidification process at a speed of more than 1000 K/s, wherein the calcium is added to the alloy in a ratio so that a density less than 2.6 g/cm$^3$ is achieved, and wherein step a) comprises combining 0.2 wgt.-% to 3 wgt.-% scandium; 1.0 wgt.-% to 8.0 wgt.-% magnesium; 0.1 wgt.-% to 1.5 wgt.-% zirconium; 0.5 wgt.-% to 5 wgt.-% calcium; and a remainder being aluminum and undesirable contaminants together in the common melt.

2. The method according to claim 1, wherein the common melt is sprayed onto a substrate as a nozzle jet by a nozzle, wherein the substrate is cooled and rotated during the application of the common melt.

3. The method according to claim 1, wherein the substrate is rotated so quickly that the quenched common melt is spun off from the substrate from an impact region of the nozzle jet on the substrate.

4. The method according to claim 1, wherein the method is carried out under atmospheric conditions.

5. The method according to claim 1, wherein step a) comprises the step of:

combining an aluminum-magnesium master alloy, an aluminum-scandium pre-alloy, or an aluminum-calcium pre-alloy into the common melt.

6. The method according to claim 1, further comprises combining, in addition to step a), additional admixtures of elements $M^1$, $M^2$, $M^3$, $M^4$ in amounts of 0.2 to 2.0 wgt.-% each, wherein $M^1$ and $M^2$ are each selected from the group consisting of copper, magnesium, manganese, silicon, iron, beryllium, lithium, chromium, zinc, silver, vanadium, nickel, cobalt and molybdenum, where $M^1$ is different than $M^2$, $M^3$ is selected from the group consisting of zirconium, niobium, tantalum, hafnium and titanium, and $M^4$ is selected from the group consisting of the rare earth metals.

7. The method according to claim 1, wherein the step of quenching the common melt by the rapid solidification process comprises quenching the common melt by the rapid solidification process at a speed of between 10,000 K/s to 10,000,000 K/s.

* * * * *